US005137279A

United States Patent [19]

Murphy et al.

[11] Patent Number: 5,137,279

[45] Date of Patent: Aug. 11, 1992

[54] POLITICAL CANDIDATE CAMPAIGN BOARD GAME

[75] Inventors: Daniel L. Murphy; Paula N. Chavez, both of Palo Alto, Calif.

[73] Assignee: Campaign Headquarters, Inc., Palo Alto, Calif.

[21] Appl. No.: 654,825

[22] Filed: Feb. 13, 1991

[51] Int. Cl.[5] ..... A63F 3/00

[52] U.S. Cl. ..... 273/257; 273/288

[58] Field of Search ..... 273/257, 251-254, 273/249, 288, 244-247, 243

[56] References Cited

U.S. PATENT DOCUMENTS

| | | | |
|---|---|---|---|
| 2,932,518 | 4/1960 | Burros | 273/148 A |
| 3,318,601 | 5/1967 | MacLeod | 273/257 |
| 3,929,332 | 12/1975 | Kidd | 273/150 |
| 4,049,276 | 9/1977 | Hole | 273/252 |
| 4,283,059 | 8/1981 | Beeder | 273/254 |
| 4,299,390 | 11/1981 | Delgado | 273/257 |
| 4,625,970 | 12/1986 | Childs et al. | 273/257 |
| 4,932,667 | 6/1990 | Gorski et al. | 273/249 |
| 4,979,324 | 12/1990 | Rehtmeyer et al. | 273/254 |

FOREIGN PATENT DOCUMENTS 641446 8/1962 Italy ..... 273/244

OTHER PUBLICATIONS

"In The Know Game", Fruit Wheats Cereal, Nabisco, Nov. 1988.

*Primary Examiner*—Benjamin Layno

*Attorney, Agent, or Firm*—Flehr, Hohbach, Test, Albritton & Herbert

[57] ABSTRACT

The board game of the present invention is a political candidate campaign board game, wherein the object of the game is to obtain score points in the form of votes. There are two playing surfaces and two distinctive playing pieces are assigned to each player. One playing surface is a path portion with indicia containing political questions and the second surface is a geographic portion with indicia containing electoral votes required to win a particular geographic region. The board game may further include three sets of cards: "Ad Cards", "Consultant Cards" and "Theme Cards". The set of "Ad Cards" contain "Attack Cards" and "Rebuttal Cards" to be used in conjuction with answers players may give to the indicia containing political questions on the path portion.

9 Claims, 4 Drawing Sheets

POLITICAL CANDIDATE CAMPAIGN BOARD GAME

BACKGROUND OF THE INVENTION

This invention relates to a political board game. More specifically, this invention relates to a game which simulates conditions which actually exist in a political campaign such as attacks by opponents, press scrutiny, public opinion and the need for money.

Political board games have been known for many years. Typically, these games include means by which to score points in the form of votes such that the winning game participant is elected to office. Games exhibiting vote accumulating formats include those described in U.S. Pat. Nos. 3,545,762, 4,299,390 and 4,709,926.

Each game varies in its rules and means by which a game participant wins the game. However, such games do not focus upon the most prevalent and interesting aspects of campaigning, that is, as noted above, attacks by opponents, press scrutiny, public opinion and the need for money.

It is therefore an object of the present invention to incorporate the aforementioned prevalent and interesting aspects of campaigning into the present invention.

It is another object of the present invention to keep the rules of the game simple.

It is another object of the present invention to involve an overall theme of the modern day televised campaign into the game.

It is yet another object of the present invention to allow the players of the game to be able to have strong identification with the indicia of the game.

It is another object of the present invention to provide entertainment for the players of the game.

Other objectives will become apparent from the following description of the invention.

SUMMARY OF THE INVENTION

In the last thirty years there has been an evolution in the types of campaigns launched by those seeking political office. Television has become the dominant forum for candidates. It is clear that sound bites on television have an enormous impact on the voting public. Moreover, the range of topics raised by candidates or reported in the news has broadened to include topics such as highly personal information and constantly updated polling statistics.

Attacks by a candidate's opponents have become compellingly newsworthy as has a candidate's constant need for money to keep a campaign in motion. Furthermore, while political consultants play a substantial role in a politician's campaign, they are generally not in the voting public's plain view. At least some of the foregoing elements are incorporated into the instant game in order to meet the above objectives and to directly coincide with the realities of campaigning.

A game board of the present invention is arranged having a path portion and a geographic portion. The path portion contains sequential playing sections, some of which have indicia concerning campaign questions which might be asked of a candidate. The geographic portion includes playing sections having indicia that represent geographic areas, which in the present embodiment, are states. Each player has two playing pieces. The first playing piece is preferably in the shape of a television and is used to move about the path portion. The second playing piece is preferably in the shape of an airplane or jet and is used to move about the geographic portion. Furthermore, there are three sets of playing cards; "Ad Cards," "Consultant Cards," and "Theme Cards." There is also play money for use during the game.

To begin the game, a sufficient number of, what the inventors call, "Ad Cards" are distributed to each player. The "Ad Cards" contain both "Attack Cards" and "Rebuttal Cards," the importance of which will be seen below. The first player to move may be chosen by rolling dice and having the highest number. An initial allotment of play money is also provided. Below, examples like setting up headquarters and purchasing "Ad Cards" and "Consultant Cards" are illustrative of the use of money.

The first player's move begins by picking a geographic playing section, that is, a state in which to campaign and then moving a playing piece in the shape of a jet to that state. The first move to the state is for the purpose of setting up headquarters which, in the preferred embodiment, costs money. After votes have been established in that state by that particular player, the fee to fly there again may be reduced.

The first player may then roll the dice such that a number is generated. Of course, any random number generator may be used. The first player then may move his/her playing piece, which is in the shape of a television, along the path portion accordingly. Typically the first player lands on a playing section bearing indicia concerning a campaign question which elicits a response. The first player is required to respond, preferably in a manner consistent with winning a presidential campaign.

It is at this point the other players look through the "Ad Cards" which they have been dealt to see if they possess an "Attack Card" to attack the first player's response to the campaign question. If one of the other players attacks the first player with an "Attack Card," the first player has the opportunity to rebut the attack.

In order for the first player to rebut the attack, the first player may draw a "Rebuttal Card" from his/her hand. If the first player does not choose to draw it, or does not possess a "Rebuttal Card," the first player loses his/her turn. If the first player does draw a "Rebuttal Card", he/she does not lose his/her turn. In that event, if the first player is willing to pay money for it, the first player may draw a "Consultant Card."

The "Consultant Cards" may provide an opportunity to obtain "Ad Cards." They may also provide insight into press scrutiny and public opinion, as well as methods for soliciting campaign contributions for the candidates. Moreover, "Consultant Cards" may also provide negative information which typically does not result in a favorable outcome for the candidate. Most importantly, however, the "Consultant Cards" provide the candidates with scoring means, that is, votes. If the first player receives votes, that is, scores via the "Consultant Card" which he/she picked, the first player uses the indication means to denote the winning of votes. The inventors choose to call the indication means "Voter Blocs," and in the preferred embodiment, these "Voter Blocs" are in the shape of stars and represent a particular number of electoral votes, most preferably, five. Furthermore, the "Voter Blocs" are placed upon the geographic playing sections of the game board. Point tallying means generally consists of counting the voter blocs.

It can be envisioned that the "Consultant Cards" could provide other types of devices by which a candidate may obtain money and votes. For example, the "Consultant Cards" may provide endorsements or means by which a candidate can develop a theme. A theme, which is on a "Theme Card" is used for making a candidate immune to attack on a particular political issue. Consultant cards may also provide dirty tricks, which may enable a candidate to obtain funds in an unorthodox manner. Furthermore, "Ad Cards" may provide other functions in addition to attacks and rebuttals. Nothing in this disclosure is intended to limit the scope of this invention as defined by the claims.

As can be seen from the foregoing, the object of incorporating prevalent and interesting aspects of campaigning while keeping the rules of the game simple is achieved. The players are essentially guided by the contents of the cards. Players are only required to know that they must pick a state, move along the path portion, answer a question, attack, rebut, pick a consultant card or a theme card and pay play money at the appropriate times.

The overall theme of the modern day televised campaign is incorporate into the game by the content of the "Ad Cards" and "Consultant Cards" and the playing pieces shaped like televisions, plus other factors. Furthermore, in the preferred embodiment, a considerable number of the "Ad Cards" and the "Consultant Cards" have a factual basis. Accordingly, the design of the game may provide the players with strong identification with the indicia of the game. Finally, the inventors believe that the objective of providing entertainment for the players of the game is also met by the method of play, the strategies the players might develop and the indicia the inventors provide.

The foregoing and other objects and advantages of the invention will become apparent from inspection of the detailed description of the invention, from the attached drawings, and from the claims.

DETAILED DESCRIPTION OF THE PREFERRED EMBODIMENT

Figure 1:
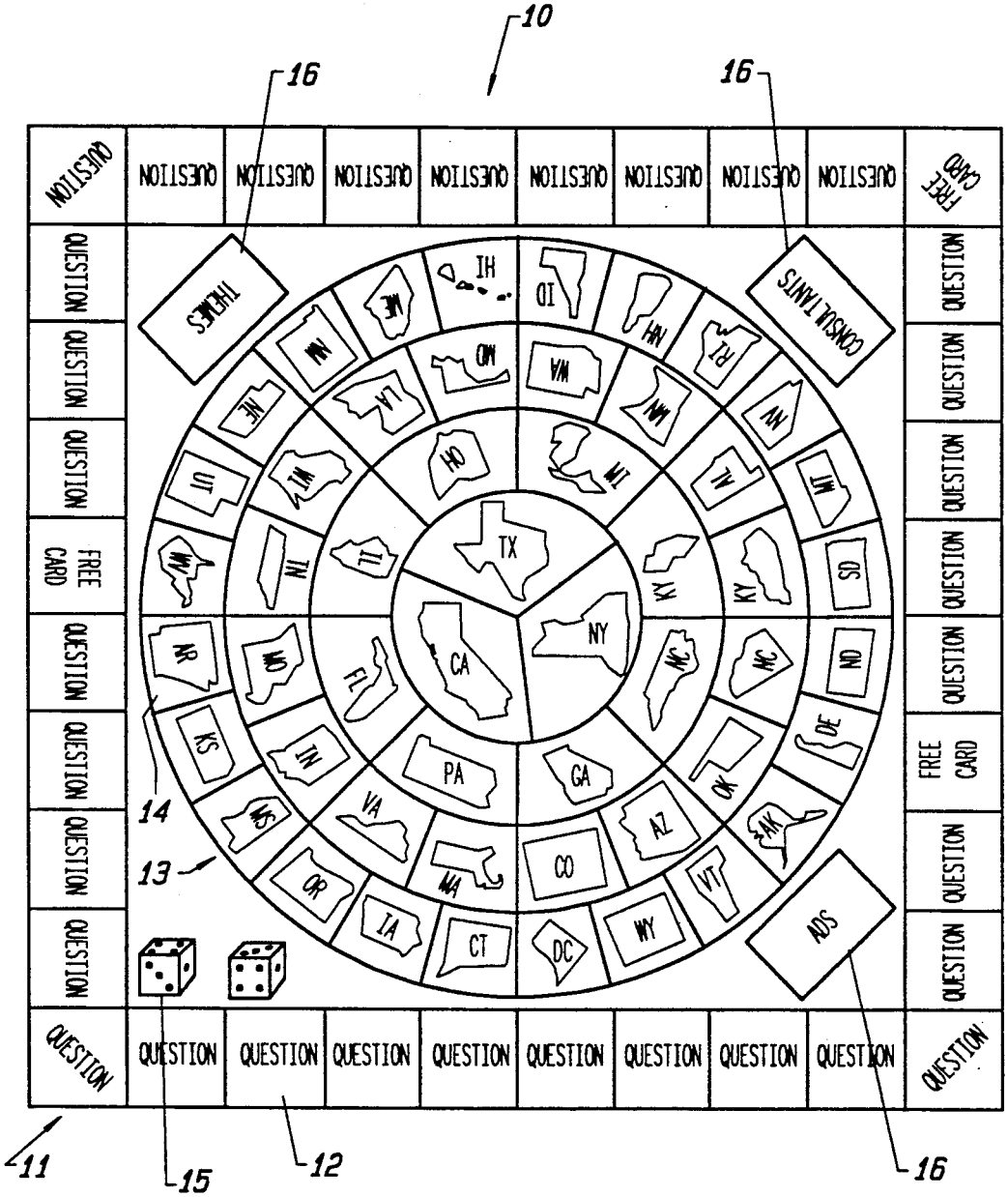
FIG. 1 shows a game board of the preferred embodiment.

A playing board 10 for the board game of the instant invention is defined by two playing surfaces as shown in FIG. 1. The first playing surface includes path portion 11, which in the preferred embodiment, encompasses the perimeter of playing board 10 and has a multiplicity of consecutive playing sections 12. The second playing surface includes geographic portion 13 and has a multiplicity of geographic sections 14. Geographic portion 13 has a circular shape divided up into geographic sections wherein the states of the United States are placed within the geographic sections 14.

The layout of the geographic portion 13 described herein of the preferred embodiment accommodates the placement of jets (FIG. 7) described above within the boundaries of the geographic sections 14, as well as the placement of the indication means shaped like stars (FIG. 8) for designating points gained. However, it can be envisioned that the second playing surface be a surface separate from the first playing surface, and that each could take distinctly different shapes than those described herein. For example, the second playing surface could have indicia realistically depicting the geographic shape of the United States. Furthermore, the geographic section may depict the geography of a country different than the United States. The United States is used here because it provides the quintessential example of campaigning. It should be noted that the description of the preferred embodiment is not intended to limit the scope of the claims.

Figure 2:
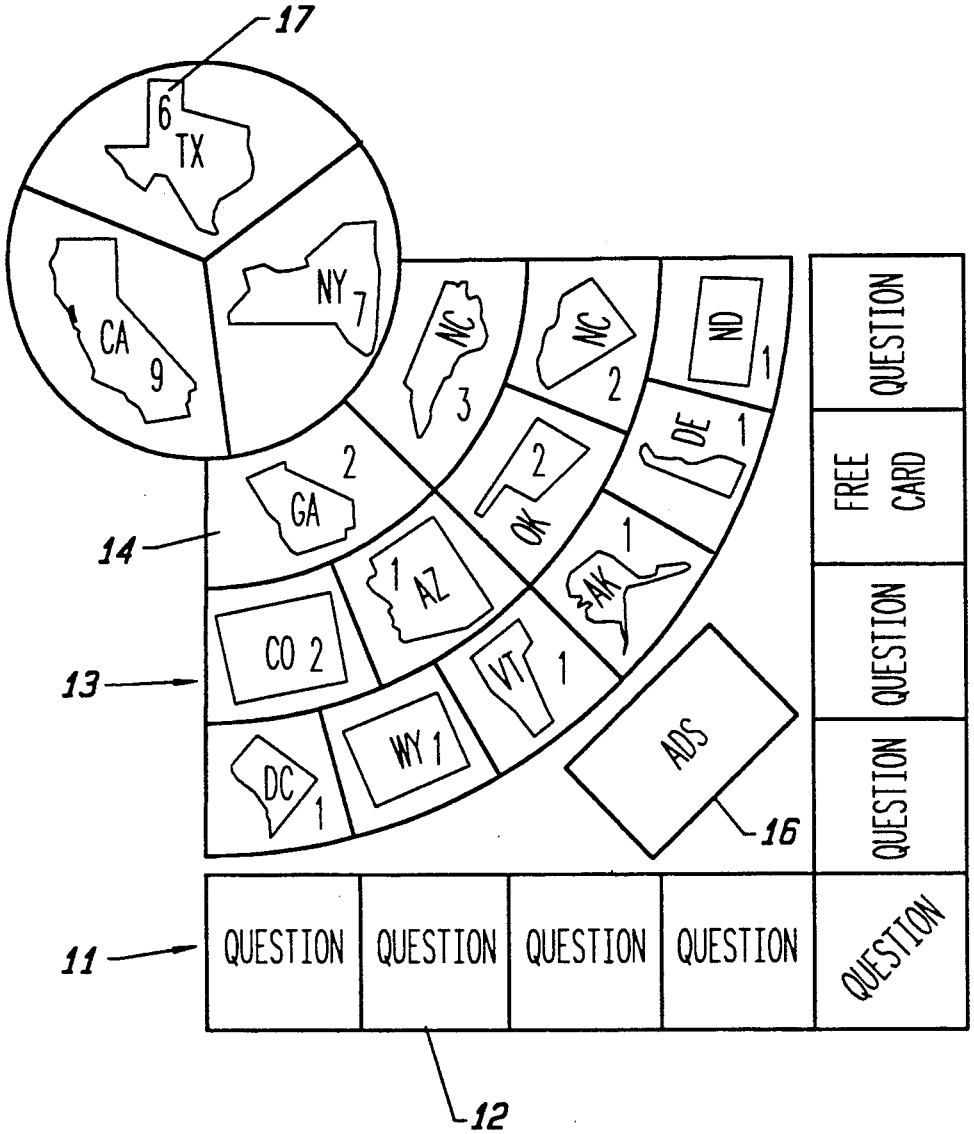
FIG. 2 shows a corner of the game board illustrating how indicia may be contained on the path portion playing section or geographic portion playing sections.

FIG. 2 depicts a quarter of the game board 10. Path portion 11 is shown wherein the first indicia containing campaign questions is on some of the consecutive playing sections 12. Some questions are as follows:

Do you have any skeletons in your closet?
Do you have a plan to balance the budget?
Are you competent to be President?
Will you be a strong leader?
Have you been soft on crime?
Are you a liberal?
Are you a conservative?
Do you believe in a fair trade policy?

The foregoing questions generally require a response. Preferably, the player answering the questions would answer in a manner favorable to a candidate's campaign. Some questions can be answered both in the affirmative or the negative, each answer being favorable to a candidate's campaign.

Figure 9:
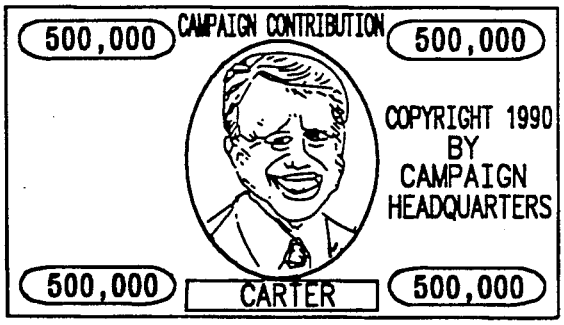
FIG. 9 shows money to be used during the course of playing the game of the present invention.

As stated above, players initially receive "Ad Cards" (FIG. 3*a* and 3*b*), a first distinctive playing piece (FIG. 6), a second distinctive playing piece (FIG. 7) and play money (FIG. 9). The rectangle labeled 16 indicates a place to stack cards, such as the "Ad Cards" (FIG. 3*a* and 3*b*), which may be drawn during the game. FIG. 1 also shows rectangles labeled 16 to indicate where to stack the "Consultant Cards" (FIG. 4) and "Theme Cards" (FIG. 5). Such placement of the cards provides easy access to the players throughout play.

Figure 6:
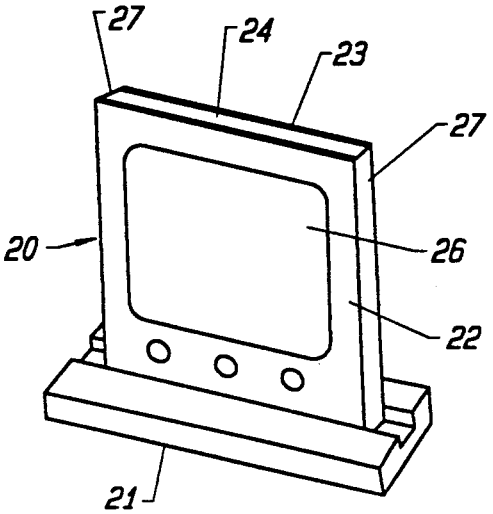
FIG. 6 shows an example of a distinctive playing piece shaped like a television.

FIG. 6 depicts one of the first distinctive playing pieces which is in the shape of a television 20 with base 21, such being in the same color as the playing pieces shaped like jets (FIG. 7) and the stars (FIG. 8) in order to identify which piece belongs to which player.

The television 20 consists of two flat members, a front flat member 22 and a rear flat member 23, separated by a space 24. Preferably, at least the front flat member 22 is made from a transparent material so that the screen 26 depicted on television 20 has a transparent front face with an opaque television frame 23 surrounding screen 22. The opaque television frame 23 may be printed on a decal, for example, and then placed upon the transparent front flat member 22. Furthermore, end pieces 27 enclose space 24 to provide means for placing an image within the screen portion 22. An image in the form of a piece of paper with a picture, say of one of the players, may be placed within space 24, the image facing through the screen portion 22, thereby creating the illusion that the player is "on television." This helps incorporate the overall theme of the modern day televisioned campaign into the instant invention.

Figure 7:
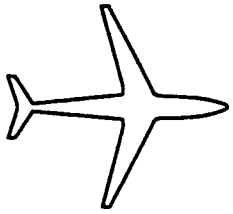
FIG. 7 shows an example of a distinctive playing piece shaped like a jet.
Figure 8:
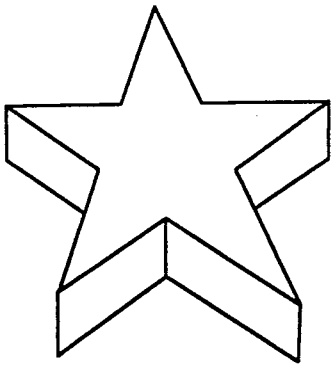
FIG. 8 shows an example of an embodiment of indication means, such shaped like a star.

As stated above, the second distinctive playing pieces are in the shape of jets (FIG. 7). In the preferred embodiment, the jet is simply cut out of a flat piece of substantially sturdy material, such as plastic. This configuration provides an inexpensive method of producing the jets, plus it allows players to stack their jets on top of each other in the event they are playing the same state.

Figure 3A:
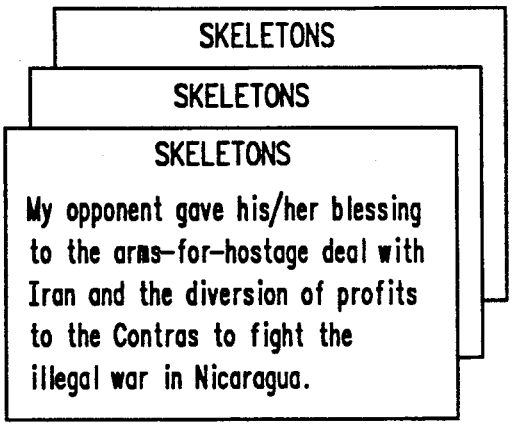
FIG. 3*a* shows a plurality of "Ad Cards" which are "Attack Cards."
Figure 3B:
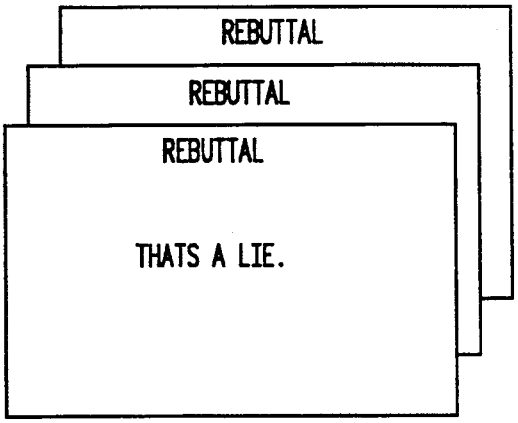
FIG. 3*b* shows a plurality of "Ad Cards" which are "Rebuttal Cards."

FIGS. 3*a* and 3*b* show the "Ad Cards" the players are initially dealt and which they may draw during the game. The "Ad Cards" consist of "Attacks" and "Rebuttals." As stated above, a first player picks a state, that is, a geographic playing section 14, pays play money (FIG. 9) to fly there, places his/her jet on that state, then randomly generates a number by, for example, rolling the dice 15. Starting from, for example, a square marked "DAY OFF," the player then moves his/her television along the path portion 11 to a playing section 12. Most likely, he/she has landed on a playing section 12 bearing indicia containing a campaign question requiring the player's response. For example, the player may land on one of the questions listed above, "Do you have any skeletons in your closet?" The player, most likely, in the spirit of the game, will say "no." It is at this point the other players search through their hands of "Ad Cards" for an "Attack" which will discredit the first player's "no" answer. If none of the other players have an appropriate "Attack Card" the first player may then draw a "Consultant Card." However, if another does play an "Attack Card" against the first player, the first player may rebut the "Attack Card" with a "Rebuttal Card." If the first player does not rebut the "Attack Card," the first player loses his/her turn, and another player is allowed to pick a state, and so on.

The "Attack" cards (FIG. 3*a*) are essentially set up as follows. Each will have a heading which ties the card into a particular question. "Attack Cards" for the above questions have headings on them such as the following denoted in capital letters:

Do you have any skeletons in your closet?—SKELETONS

Do you have a plan to balance the budget?—BALANCE BUDGET

Are you competent to be President?—COMPETENT

Will you be a strong leader?—STRONG LEADER

Have you been soft on crime?—SOFT ON CRIME

Are you a liberal?—LIBERAL

Are you a conservative?—CONSERVATIVE

Do you believe in a fair trade policy?—FAIR TRADE POLICY

These headings will alert the players as to which 18 card to play against which question. An "Attack Card" which could be played against a negative response to "do you have any skeletons in your closet?" may be as follows:

SKELETONS—My opponent gave his/her blessing to the arms-for-hostages deal with Iran and the diversion of profits to the Contras to fight the illegal war in Nicaragua.

SKELETONS—My opponent confessed to having used marijuana in his/her younger days.

SKELETONS—Rumors have surfaced about my opponent's extramarital affairs.

SKELETONS—My opponent's running mate voluntarily subjected himself to electro-shock therapy.

SKELETONS—My opponent has been treated for depression twice.

SKELETONS—My opponent is a cheat, a thief and a half-breed.

When a second player plays an appropriate "Attack Card" against a first player's response to a campaign question, the first player has an opportunity to rebut the "Attack Card" with a "Rebuttal Card" (FIG. 3*b*). The "Rebuttal Cards" will be distinct from the "Attack Cards" because the word REBUTTAL will be the heading of the card. A "Rebuttal Card" may be as follows:

REBUTTAL—That's a lie.

REBUTTAL—I recently authored legislation to address that exact issue.

REBUTTAL—My actions were governed by legislative requirement, not by presidential politics.

REBUTTAL—I served my country bravely in the war.

REBUTTAL—I will not compare myself to the other candidates.

REBUTTAL—So?

The foregoing "Rebuttal Cards" are purposely not responsive to specific "Attack Cards." The inventors find this aspect of the present invention quite true to reality as rarely is a response by a political candidate responsive to the issue actually posed. However, it could be envisioned that the "Rebuttal Cards" could be specifically directed to the issue of the "Attack Cards." The foregoing description is not intended to limit the scope of the claims.

If the first player is able to play a "Rebuttal Card," he/she will be mostly likely able to draw a "Consultant Card." However, in the preferred embodiment of the instant invention, the inventors have introduced a twist to the foregoing sequence of events. If the first player uses a "Rebuttal Card" which states "That's a lie," the players may look up that "Attack Card" in a book of actual attacks which lists each card by number and which may be packaged with the game. The "Attack Cards" are numbered for reference to the book. If the "Attack Card" used is actually true with respect to a real life politician, that politician will be listed by name in the book of actual attacks according to the number assigned to the "Attack Card."

The book of actual attacks enables the players to use their knowledge of politics to their advantage. If a player is familiar with the attack, they would probably not use the "That's a lie" "Rebuttal Card" to defend themselves. If they have another "Rebuttal Card," they may choose the other "Rebuttal Card" to defend themselves. Furthermore, the book of actual attacks adds an educational element to the game, as some attacks may be so unbelievable, that the players cannot imagine that they were actually uttered or are actually true. In this situation, the player may be prompted to use the "That's a lie" "Rebuttal Card" and then when looking the "Attack Card" up in the book of actual attacks, find to their surprise that the attack is based on fact in one way or another.

Figure 4:
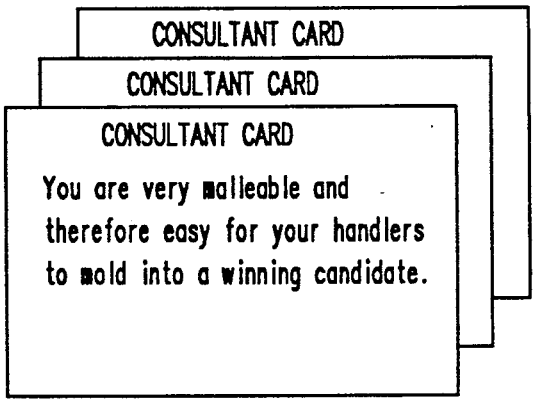
FIG. 4 shows a plurality of "Consultant Cards."
Figure 5:
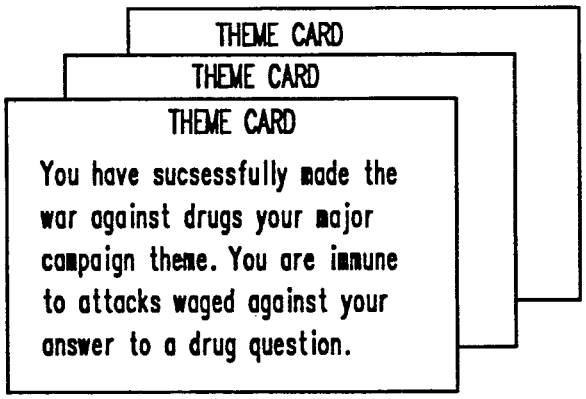
FIG. 5 shows a plurality of "Theme Cards."

If the first player has successfully either avoided an attack because the other players did not possess an appropriate "Attack Card," or the first player was able to play a "Rebuttal Card" which nullified the attack by the "Attack Card," the first player may pay play money (FIG. 9) and pick a "Consultant Card" (FIG. 4).

"Consultant Cards" of the present invention are used to obtain money and votes. However, "Consultant Cards" may also provide bad news such as losses in the polls, etc. Some examples of "Consultant Cards" are as follows:

CONSULTANT CARD—You may purchase up to 3 "Ad Cards" for $1M each.

CONSULTANT CARD—Your campaign managers have developed a theme for your campaign. You may purchase a "Theme Card" for $1M.

CONSULTANT CARD—Voters are blaming you for not fighting back more than they are blaming your principal opponent for attacking you so mercilessly. You get no votes or money.

CONSULTANT CARD—You are very malleable and therefore easy for your handlers to mold into a winning candidate. You get 2 voter blocs.

CONSULTANT CARD—Your campaign team is well versed in the art of the technologies of television, polling and direct mail. You get 2 voter blocs and $2M.

CONSULTANT CARD—You've got incredible connections. You get $1M.

CONSULTANT CARD—You have eloquently delivered about the poor and downtrodden. You get 1 voter bloc.

CONSULTANT CARD—You look tired and are beginning to lose your energetic image. You get no votes or money.

As can be seen from the foregoing listed "Consultant Cards," any number of outcomes may occur when picking a "Consultant Card." If the player picks a "Consultant Card" which provides that player with votes, that is, provides scoring means, the player uses indication means, which in the preferred embodiment, are "Voter Blocs" in the shape of stars (FIG. 8), and places them on the geographic section 14 which is occupied by that player's jet.

At the end of the game, which will be described below, the players tally the votes and whoever has won the most electoral votes, wins the game. It should be noted that, in the United States, each state is assigned a certain number of electoral votes, and when a candidate wins a majority of votes cast in that state, that candidate wins all of the electoral votes for that state. FIG. 2 shows geographic sections 14 which have indicia containing information regarding the maximum electoral votes achievable by winning a majority of votes cast per state. In the preferred embodiment, the electoral votes 17 is in the form of maximum "Voter Blocs," such being essentially the number of electoral votes of a state divided by five. Therefore, a "Voter Bloc" represents about five electoral votes. If the game is adapted to the United States, foregoing description of the electoral vote system should apply as a means for tallying the votes.

There is another way a player may avoid an attack by an opponent. A player may obtain a "Theme Card," (FIG. 5) such that the "Theme Card" designates a player as immune to attack regarding one or more campaign questions. A "Theme Card" may have indicia as follows:

THEME CARD—You have successfully made the war against drugs your major campaign theme. You are immune to attacks waged against your answer to a drug question.

THEME CARD—By saying "Read My Lips" you have convinced the voters that you would veto any tax increase bill and spending increase bill. You are immune to attacks waged against your answer to a tax question or a spending increase question.

THEME CARD—Because you are the incumbent president, you are immune to attacks waged against your competency and leadership qualifications.

Preferably, when the player draws the "Theme Card," he/she reads it aloud, and then keeps it from view of the other players. The other players are then charged with remembering that a particular player is immune to attack on a campaign question. If another player does not remember that the first player possesses a "Theme Card", when the first player lands on the corresponding playing section having indicia containing a campaign question, and the first player answers the inquiry, another player may futilely play an "Attack Card" and waste his/her valuable "Attack Card." If this occurs, the first player may then pick a "Consultant Card."

The number of players of the game will determine how many "Theme Cards" are placed in rectangle labeled 16 in FIG. 2 at the outset of the game. When the last theme card is drawn, that signals the end of the game. At that time, the players tally the votes, and a winning game participant is determined.

While the invention has been herein shown and described in what is presently conceived to be the most practical and preferred embodiment of the invention, it will be apparent to those of ordinary skill in the art that many modifications thereof may be made within the scope of the invention, which scope is to be accorded to broadest interpretation of the claims so as to encompass all equivalent structures and devices.

We claim:

1. A political candidate campaign board game apparatus which includes playing cards and playing pieces, for use by a plurality of game participants comprising:

a playing board defining a first playing surface having a path portion which has a multiplicity of consecutive playing sections;

first indicia containing campaign questions requiring a response selected from the group consisting of yes and no, by at least one of said game participants, answers to which would be favorable to a candidate's said first indicia on at least some of said consecutive playing sections; and a first set of playing cards to be distributed to game participants throughout play, some of which being attach cards having second indicia corresponding to the first indicia and having information in the form of a statement responding to said game participant's yes or no response.

2. An apparatus as recited in claim 1 wherein some of said first set of playing cards further comprises rebuttal cards, such having third indicia which contain information for rebutting said second indicia contained in said attach cards.

3. An apparatus as recited in claim 2 further comprising:

play money;

scoring means for obtaining scoring points; and point tallying means for determining the winning game participant of the plurality of game participants.

4. An apparatus as recited in claim 3 further comprising a second set of playing cards to be distributed to game participants throughout play which are consultant cards which may provide scoring means for obtaining scoring points and/or means for obtaining play money.

5. An apparatus as recited in claim 4 further comprising:

a first plurality of distinctive playing pieces for moving on said path portion, each of which represents one of said game participants; and number generator means for randomly generating a number, such determining the number of playing sections on said path portion a playing piece may be moved during a game participant's turn at play.

6. An apparatus as recited in claim 5 further comprising a third set of playing cards, some of which being theme cards, such to be distributed to game participants throughout play and having fourth indicia for designating a game participant as immune to attack by some of said attack cards.

7. An apparatus as recited in claim 6 comprising:

a second playing surface having a geographic portion which has a multiplicity of geographic playing sections and fifth indicia containing information regarding the electorate on at least some of said geographic sections; and indication means used in conjunction with said geographical sections for designating scoring points scored.

8. An apparatus as recited in claim 7 further comprising a second plurality of distinctive playing pieces for positioning on said geographical sections, each of which represents one of said game participants, such positioning determining the location a game participant employs said indication means.

9. A board game apparatus which includes playing cards and playing pieces, for use by a plurality of game participants comprising:

a playing board defining a first playing surface having a path portion which has a multiplicity of consecutive playing sections;

a plurality of distinctive playing pieces for moving on said path portion to represent game participants and which resemble television sets; and number generator means for randomly generating a number, such determining the number of playing sections on said path portion a playing piece may be moved during a game participant's turn at play;

first indicia containing campaign questions requiring a response selected from the group consisting of yes and no by at least one of said game participants, said first indicia on at least some of said consecutive playing sections; and a first set of playing cards to be distributed to game participants throughout play, some of which being attack cards having second indicia corresponding to said firs indicia and having information in the form of a statement responding to said game participant's yes or no response and some of said first set of playing cards being rebuttal cards having third indicia which contain information for rebutting said second indicia contained in said attack cards.

* * * * *